United States Patent [19]

Ranner

[11] Patent Number: 4,562,891

[45] Date of Patent: Jan. 7, 1986

[54] FRONT VEHICLE BLADE MOUNT

[75] Inventor: Dietrich Ranner, Salzburg, Austria

[73] Assignee: Bomadier-Rotax-Wien Produktions- und Vertriebsgesellschaft mbH, Vienna, Austria

[21] Appl. No.: 600,112

[22] PCT Filed: Jul. 28, 1983

[86] PCT No.: PCT/AT83/00023

§ 371 Date: Mar. 28, 1984

§ 102(e) Date: Mar. 28, 1984

[87] PCT Pub. No.: WO84/00570

PCT Pub. Date: Feb. 16, 1984

[30] Foreign Application Priority Data

Jul. 30, 1982 [AT] Austria ..... 2956/82

[51] Int. Cl.[4] ..... E02F 3/76

[52] U.S. Cl. ..... 172/821; 172/826

[58] Field of Search ..... 172/818, 819, 820, 821, 172/824, 825, 826; 37/42 R

[56] References Cited

U.S. PATENT DOCUMENTS

| | | | |
|---|---|---|---|
| 3,529,678 | 9/1970 | Teasdale | 172/821 |
| 3,822,751 | 7/1974 | Waterman | 172/821 |
| 4,405,019 | 9/1983 | Frisbee | 172/821 |

FOREIGN PATENT DOCUMENTS

| | | | |
|---|---|---|---|
| 1115514 | 1/1982 | Canada | 172/821 |

*Primary Examiner*—Richard J. Johnson

[57] ABSTRACT

A hitch for mounting an implement on the front end of a vehicle relative to the normal travel direction thereof has a main frame having a rear end pivoted on the vehicle about a generally horizontal rear main axis and a front end spaced forward therefrom in the travel direction. An actuator, normally a double-acting hydraulic cylinder, is connected between the front end and the vehicle for pivoting the main frame about the main axis. A swivel joint at the front end carries the implement so that it can swivel freely on the front end by means of this joint. A rigid yoke pivoted on the front end about a front axis parallel to the rear axis has an upper end and is movable only about the front axis on the main frame. An inextensible link extends generally in the travel direction and has relative thereto a rear end pivoted on the upper end of the yoke and a front end pivoted on the implement. Thus when the implement pivots about a horizotal implement axis perpendicular to the direction and parallel to the main axis the link pivots the yoke with it about the front axis. A fitting is provided on the implement horizontally offset from the upper end of the yoke. Another actuator extends generally horizontally and transverse to the direction and has an outer end coupled to the fitting and an inner end coupled to the upper yoke end for tipping the implement about a horizontal axis extending in the travel direction through the swivel joint.

7 Claims, 3 Drawing Figures

FRONT VEHICLE BLADE MOUNT

FIELD OF THE INVENTION

The present invention relates to a hitch for mounting an implement such as a snow plow or the like to the front of a vehicle. More particularly this invention concerns such a hitch which allows the position of the implement relative to the vehicle to be changed.

BACKGROUND OF THE INVENTION

A standard front hitch has a main frame pivotal on the vehicle about a horizontal main axis extending transverse to the vehicle travel direction and having a front end carrying the implement, for instance via a ball joint. Hydraulic cylinders are connected directly between the implement and the main frame to position the implement relative to vertical and the horizontal axes, parallel and transverse to the vehicle transport direction.

Hitches of this type have the disadvantage that any actuation of one of the hydraulic cylinders produces a movement of the entire blade. Only a pure height adjustment does not change the inclination of the blade about a vertical axis without simultaneously changing its height from the ground and its angle with respect to the horizontal.

Other hitches are also known which permit angular movements of the implement about three perpendicular axes. In order to transmit the considerable forces that are required from the vehicle to the implement it is however necessary to provide a heavy-duty frame. Such a frame is expensive and represents a considerable offcenter weight to the vehicle carrying it.

OBJECTS OF THE INVENTION

It is therefore an object of the present invention to provide an improved front hitch for a snow-plow type implement.

Another object is the provision of such a front hitch for a snow-plow type implement which overcomes the above-given disadvantages, that is which is relatively light and inexpensive to manufacture, and that allows the implement to be moved about several different axes without such movement causing movement about other axes.

A further object is to provide a snow-plow front hitch which therefore allows the plow to be raised and lowered on the vehicle by means of the main frame, and that can in turn move on the front end of the main frame about a horizontal axis that is parallel to the main axis, about a vertical axis passing through the front end, and about a horizontal axis extending in the travel direction through the main-frame front end, all independently of each other. In addition the system of this at the same time affecting the angular orientation of the plow relative to the vehicle.

SUMMARY OF THE INVENTION

A hitch for mounting an implement on the front end of a vehicle relative to the normal travel direction thereof according to the invention has a main frame having a rear end pivoted on the vehicle about a generally horizontal rear main axis and a front end spaced forward therefrom in the travel direction. An actuator, normally a double-acting hydraulic cylinder, is connected between the front end and the vehicle for pivoting the main frame about the main axis. A swivel joint at the front end carries the implement so that it can swivel freely on the front end by means of this joint. A rigid yoke pivoted on the front end about a front axis parallel to the rear axis has an upper end and is movable only about the front axis on the main frame. An inextensible link extends generally in the travel direction and has relative thereto a rear end pivoted on the upper end of the yoke and a front end pivoted on the implement. Thus when the implement pivots about a horizontal implement axis perpendicular to the direction and parallel to the main axis the link pivots the yoke with it about the front axis. A fitting is provided on the implement horizontally offset from the upper end of the yoke. Another actuator extends generally horizontally and transverse to the direction and has an outer end coupled to the fitting and an inner end coupled to the upper yoke end for tipping the implement about a horizontal axis extending in the travel direction through the swivel joint.

According to the invention the swivel joint is a heavy-duty ball joint provided centrally on the front end of the hitch. Such a joint provides all the degrees of freedom needed, while at the same time being capable of transmitting considerable force.

The apparatus can also have a second fitting provided centrally on the plow above the swivel joint and a second actuator extending generally in the travel direction and having a rear end coupled to the vehicle and a front end coupled to the second fitting for tipping the plow on the frame about a horizontal axis extending perpendicular to the direction through the ball. In addition the hitch can include a third fitting provided on the plow generally level with the swivel joint and offset horizontally and perpendicular to the travel direction therefrom and a third actuator extending generally in the travel direction and having a rear end coupled to the main frame adjacent the main axis and a front end coupled to the third fitting for pivoting the plow on the frame about a horizontal axis extending parallel to the direction through the ball. Such an arrangement allows the plow to be moved into virtually any useful position without motion about any one axis substantially affecting a position set with respect to another axis, as all the axes meet in the ball joint.

The fittings according to this invention can simply be arms having outer ends connected to the respective actuator means, generally level with the opposite actuator ends, and spaced horizontally therefrom.

DESCRIPTION OF THE DRAWING

The above and other features and advantages will become more readily apparent from the following, reference being made to the accompanying drawing in which.

SPECIFIC DESCRIPTION

Figure 1:
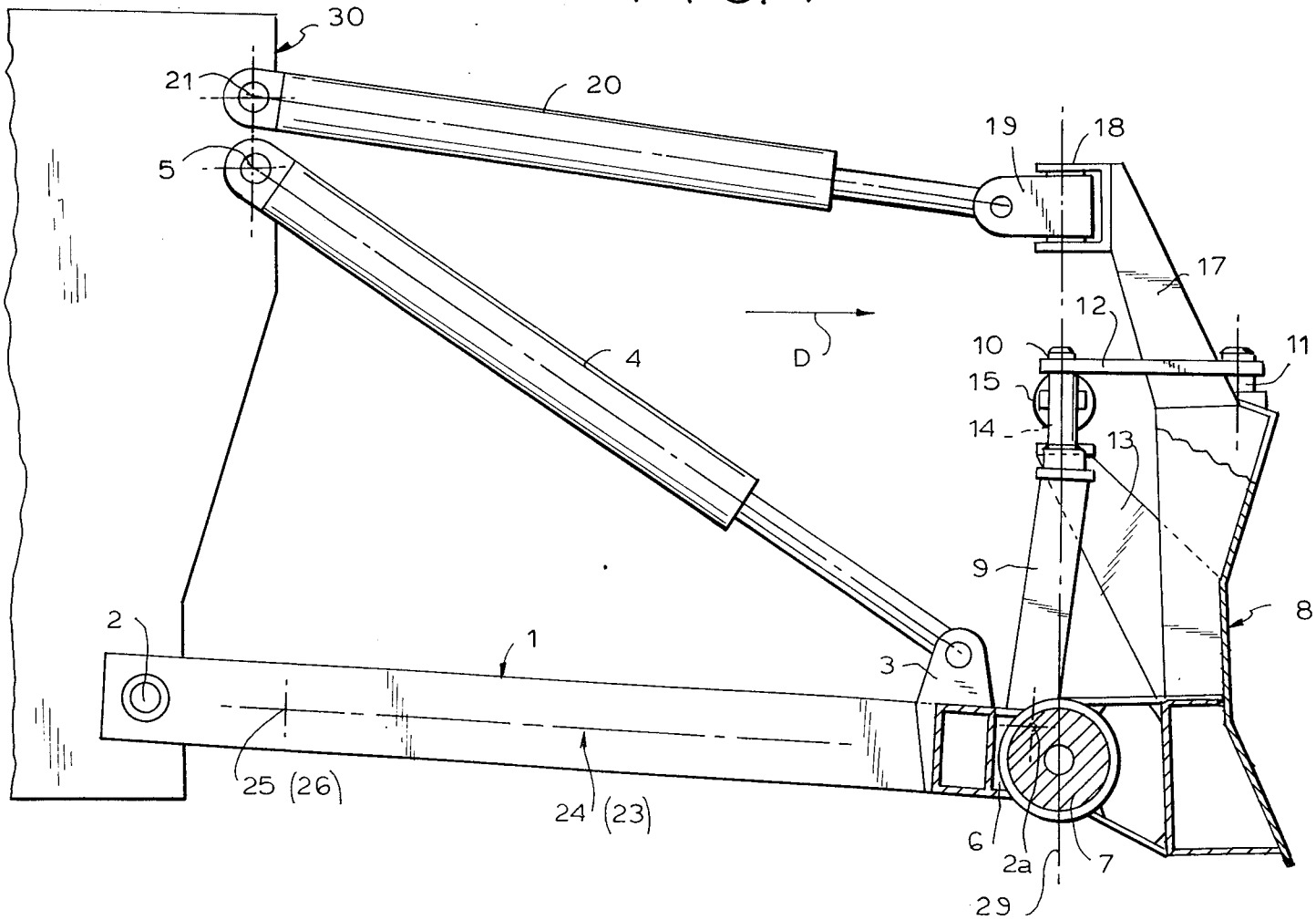
FIG. 1 is a partly diagrammatic longitudinal section through the hitch assembly of the instant invention.
Figure 2:
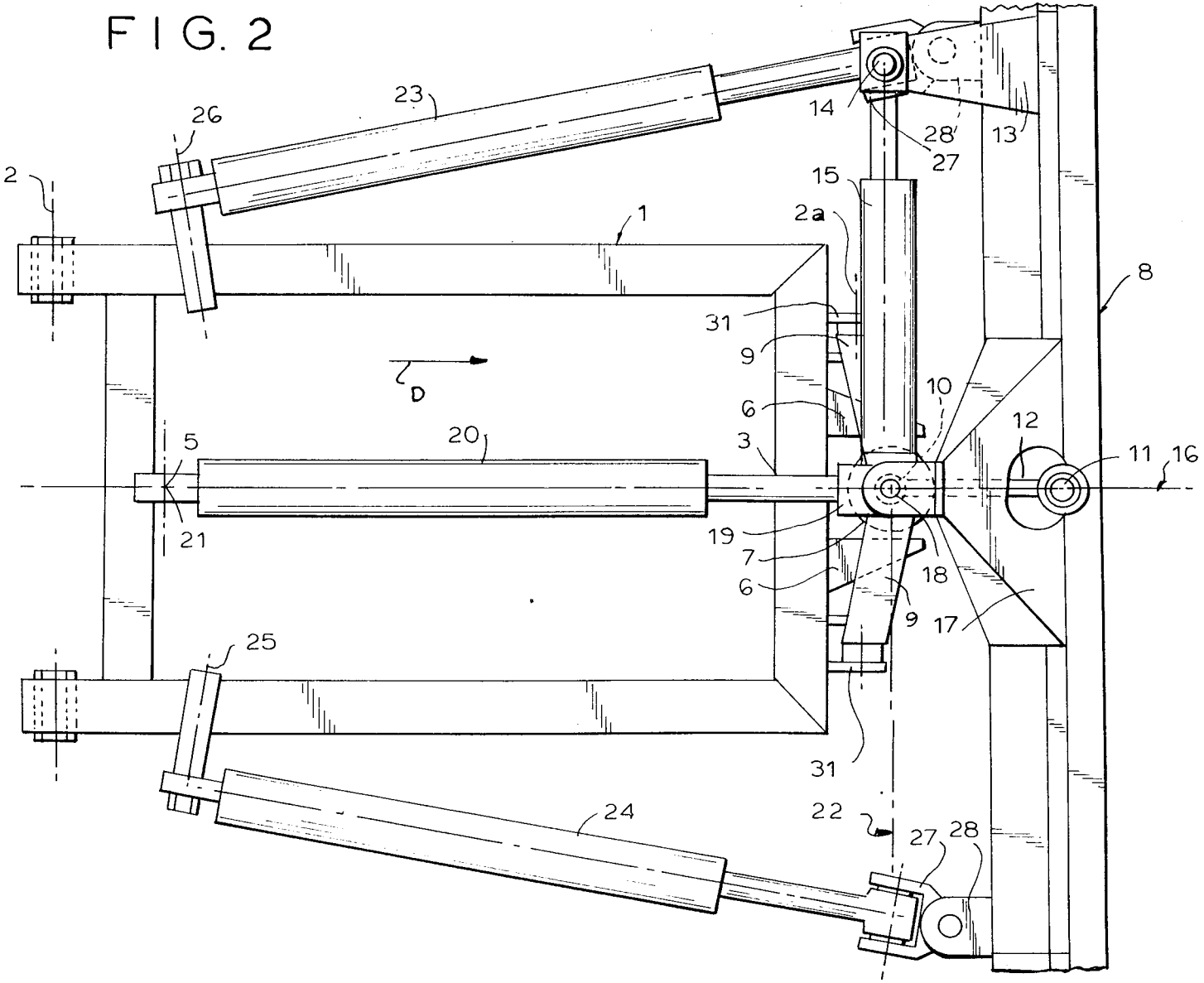
FIG. 2 is a top view of the instant invention.
Figure 3:
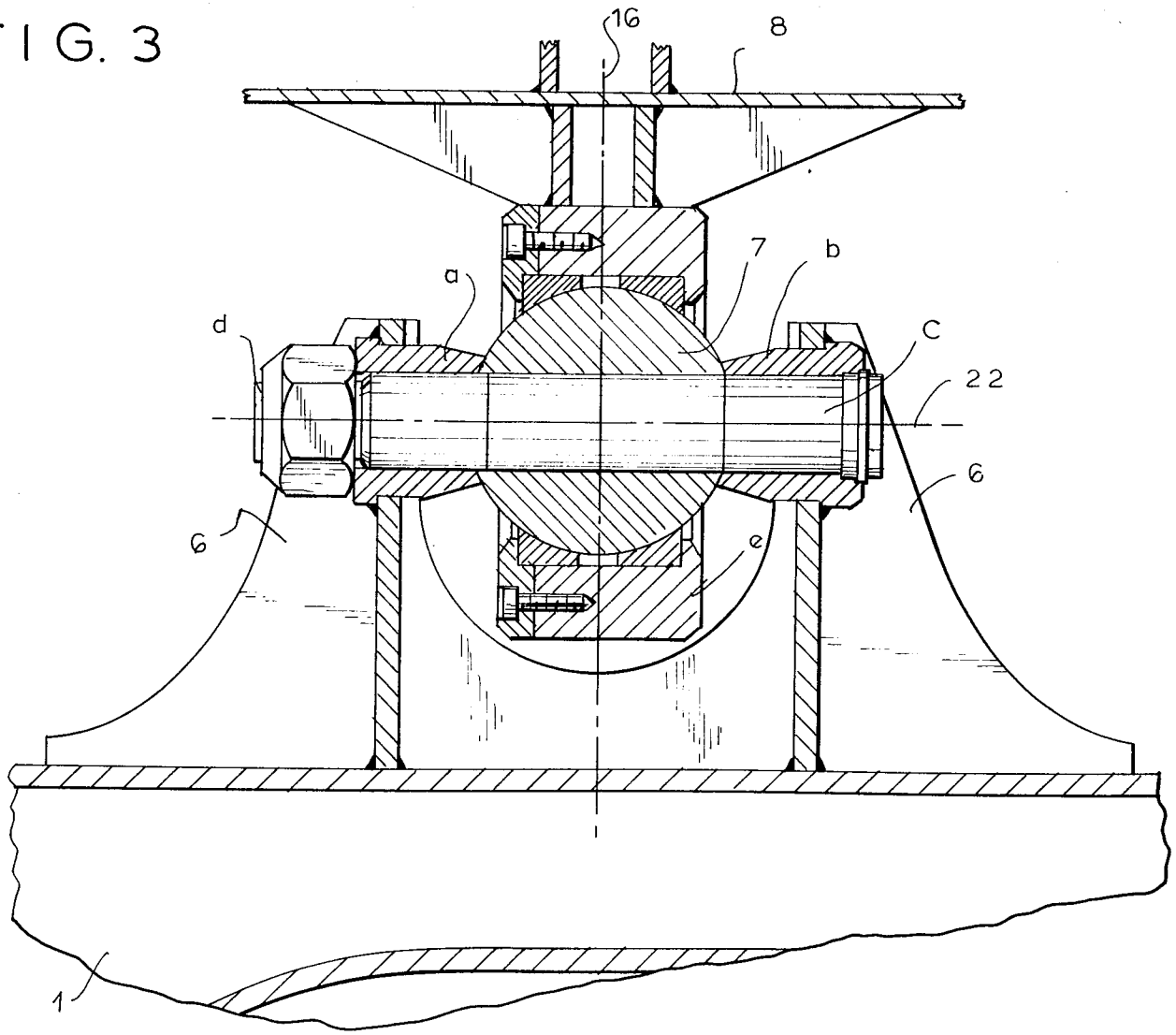
FIG. 3 is a large-scale section taken along line III—III of FIG. 2.

As seen in FIG. 1 a rigid main frame 1 lies in a horizontal plane and has, relative to a normal travel direction D, a rear end pivoted on a vehicle shown diagrammatically at 30 at an axis 2 that is horizontal and perpendicular to the travel direction D and a front end provided at its center with a lug 3. A double-acting and very heavy-duty hydraulic cylinder shown diagrammatically at 4 is pivoted between this lug 3 and a higher attachment point 5 on the vehicle. Thus expansion and contraction of this cylinder 4 will raise and lower the front end of the frame 1.

The front end of this frame 1 is provided at its center with mounts 6 carrying a ball joint 7 that carries a plow 8 that therefore is capable of three degrees of freedom of motion on the frame 1. These degrees of motion can be reduced to pivoting about:

a horizontal axis 22 that is perpendicular to the direction D, another horizontal axis 16 that is perpendicular to and that intersects the axis 22 so that it is parallel to the direction D, and a vertical axis 29 that traverses the intersection in the center of the ball 7 of the axes 22 and 16, and that is perpendicular to the direction D.

The front end of the frame 1 carries two forwardly projecting mounts 31 that define a lower pivot axis 2*a* that is parallel to the axis 2. A support yoke 9 is freely pivoted at axis 2*a* on the frame 1 and can in fact only move relative to the frame 1 about this axis 2*a*. The upper end of this yoke 9 is provided with an upwardly projecting pin 1 which can be coaxially centered on the vertical axis 29 but that under any circumstances lies in a plane extending in the travel direction D and including the axis 16. The outer left-hand end of the plow 8 is provided with a rigid arm 13 provided with a pin 14 about level with the pin 10. A double-acting hydraulic cylinder shown schematically at 15 is pivoted at its outer end on the pin 14 and at its inner end on the pin 10. Thus expansion or contraction of this cylinder 15 can tip the plow 8 about the axis 16 without substantially affecting the plow's angular orientation relative to the vehicle about the axes 22 and 29.

The plow 8 is provided centrally generally level with the pin 10 with a similar such vertical pin 11. A rigid link shown schematically at 12 has its rear end pivoted on the pin 10 and its front end on the pin 11. This link therefore permits the pins 10 and 11 to move horizontally relative to each other while still maintaining the yoke 9 at a fixed distance in the direction D from the plow 8. This link will shorten the distance in the direction D between the pins 10 and 11 when they are offset horizontally transverse to this direction, but this shortening will be minimal, especially as the extent of side-to-side tip that is used on a snow plow is not great.

Centrally the snow plow 8 has above the pin 11 an upstanding arm or turret 17 provided with one-half 18 of a universal joint whose other half 19 is carried on the front end of a double-acting hydraulic cylinder shown schematically at 20. The rear end of this cylinder 20 is pivoted at 21 by means of another such universal joint 18, 19 on the vehicle 30. Thus expansion or contraction of this cylinder 20 will tip the plow 8 respectively forward or back, without in any way affecting its side-to-side tip about the axis 16 or its position relative to the vertical axis 29.

In addition each end of the plow 8 is provided at the level of the main axis 2 with one-half 28 of a universal joint whose other half 27 is connected to a double-acting hydraulic cylinder 23 or 24 pivoted adjacent the main axis 2 at 25 and 26 on the main frame 1. Two cylinders are provided for symmetrical strength in the assembly. These cylinders 23 and 24 can therefore pivot the plow 8 about the axis 19 without, however, affecting its position relative to the two other axes 16 and 22.

The cylinders 23 and 24 are coplanar with the frame 1 and extend at the same angle to the direction D as to the cylinder 20. Thus a parallelogrammatic linkage is formed having the cylinder 20 as its upper horizontal link, the cylinders 23 and 24 and frame 1 as its lower link, and the plow 8 and vehicle 30 as its vertical side links. The plow 8 can therefore be raised or lowered by the cylinder 4 without changing its orientation relative to the axes 16, 22, and 29.

What is claimed is:

1. A hitch for mounting an implement on the front end of a vehicle relative to the normal travel direction thereof, the hitch comprising:

a main frame having a rear end pivoted on the vehicle about a generally horizontal rear main axis and a front end spaced forward therefrom in the travel direction;

actuator means connected between the front end and the vehicle for pivoting the main frame about the main axis;

a swivel joint at the front end carrying the implement, whereby the implement can swivel freely on the front end by means of the joint;

a rigid yoke pivoted on the front end about a front axis parallel to the rear axis, having an upper end, and movable only about the front axis on the main frame;

an inextensible link extending generally in the travel direction and having relative thereto a rear end pivoted on the upper end of the yoke and a front end pivoted on the implement, whereby when the implement pivots about a horizontal implement axis perpendicular to the direction and parallel to the main axis the link pivots the yoke with it about the front axis;

a fitting on the implement horizontally offset from the upper end of the yoke; and actuator means extending generally horizontally and transverse to the direction and having an outer end coupled to the fitting and an inner end coupled to the upper yoke end for tipping the implement about a horizontal axis extending in the travel direction through the swivel joint.

2. The front hitch defined in claim 1 wherein the swivel joint is a heavy-duty ball joint provided centrally on the front end of the hitch.

3. The front hitch defined in claim 1 wherein the fitting is an arm having an upper end connected to the respective actuator means, generally level with the upper yoke end, and spaced therefrom perpendicular to the direction.

4. The front hitch defined in claim 1, further comprising:

another fitting provided centrally on the plow above the swivel joint; and actuator means extending generally in the travel direction and having a rear end coupled to the vehicle and a front end coupled to the other fitting for tipping the plow on the frame about a horizontal axis extending perpendicular to the direction through the swivel joint.

5. The front hitch defined in claim 1, further comprising:

another fitting provided on the plow generally level with the swivel joint and offset horizontally and perpendicular to the travel direction therefrom; and actuator means extending generally in the travel direction and having a rear end coupled to the main frame adjacent the main axis and a front end coupled to the other fitting for pivoting the plow on the frame about a horizontal axis extending parallel to the direction through the swivel joint.

6. The front hitch defined in claim 1 wherein the actuator means is a hydraulic cylinder.

7. A hitch for mounting an implement on the front end of a vehicle relative to the normal travel direction thereof, the hitch comprising:

a main frame having a rear end pivoted on the vehicle about a generally horizontal rear main axis and a front end spaced forward therefrom in the travel direction;

actuator means connected between the front end and the vehicle for pivoting the main frame about the main axis;

a swivel joint at the front end carrying the implement, whereby the implement can swivel freely on the front end by means of the joint;

a rigid yoke pivoted on the front end about a front axis parallel to the rear axis and having an upper end and movable only about the front axis on the main frame;

an inextensible link extending generally in the travel direction and having relative thereto a rear end pivoted on the upper end of the yoke and a front end pivoted on the implement, whereby when the implement pivots about a horizontal implement axis perpendicular to the direction and parallel to the main axis the link pivots the yoke with it about the front axis;

a first fitting on the implement horizontally offset from the upper end of the yoke;

first actuator means extending generally horizontally and transverse to the direction and having an outer end coupled to the fitting and an inner end coupled to the upper yoke end for tipping the implement about a horizontal axis extending in the travel direction through the swivel joint;

a second fitting provided centrally on the plow above the swivel joint;

second actuator means extending generally in the travel direction and having a rear end coupled to the vehicle and a front end coupled to the second fitting for tipping the plow on the frame about a horizontal axis extending perpendicular to the direction through the swivel joint;

a third fitting provided on the plow generally level with the swivel joint and offset horizontally and perpendicular to the travel direction therefrom; and third actuator means extending generally in the travel direction and having a rear end coupled to the main frame adjacent the main axis and a front end coupled to the third fitting for pivoting the plow on the frame about a horizontal axis extending parallel to the direction through the swivel joint.

* * * * *